US005561991A

United States Patent [19]

Berkcan et al.

[11] Patent Number: 5,561,991

[45] Date of Patent: Oct. 8, 1996

[54] SYSTEM BASED ON INDUCTIVE COUPLING FOR SENSING LOADS IN A WASHING MACHINE BY MEASURING ANGULAR ACCELERATION

[75] Inventors: Ertugrul Berkcan, Schenectady; Kenneth B. Welles, II, Scotia, both of N.Y.

[73] Assignee: General Electric Company, Schenectady, N.Y.

[21] Appl. No.: 491,777

[22] Filed: Jun. 19, 1995

[51] Int. Cl.[6] ..... D06F 33/02

[52] U.S. Cl. ..... 68/12.04; 68/12.27; 73/779

[58] Field of Search ..... 68/12.02, 12.04, 68/12.06, 12.27; 73/763, 774, 779, DIG. 5

[56] References Cited

U.S. PATENT DOCUMENTS

| | | | |
|---|---|---|---|
| 3,422,957 | 1/1969 | Fosler | 68/12.06 X |
| 5,161,393 | 11/1992 | Payne et al. | 68/12.04 |
| 5,208,931 | 5/1993 | Williams et al. | 68/12.04 X |

OTHER PUBLICATIONS (GE Attorney Docket No. RD–23902) entitled "Energy Efficient Washer With Inertia Based Method for Determining Load", by Badami et al., Ser. No. 08/406,424, filed Mar. 20, 1995.

*Primary Examiner*—Philip R. Coe
*Attorney, Agent, or Firm*—Marvin Snyder

[57] ABSTRACT

A system for sensing loads in a washing machine by measuring angular acceleration is provided. The washing machine includes a washer basket and an agitator that can be angularly accelerated about a spin axis during a predetermined dry spin cycle. The system includes a magnetic source, such as a permanent magnet, positioned in the agitator for producing a predetermined magnetic field. A magnetic sensor, made-up of inductive coils or solid state sensors, is positioned to be electromagnetically coupled to the magnetic source for supplying an output signal that varies in a predetermined manner as the agitator is angularly accelerated relative to the magnetic sensor. A signal processor is coupled to the magnetic sensor for receiving the output signal supplied by the magnetic sensor. The processor is designed and/or programmed for measuring loads in the washer basket based on the output signal received from the magnetic sensor while the agitator is angularly accelerated relative to the magnetic sensor upon initiating the dry spin cycle.

18 Claims, 5 Drawing Sheets

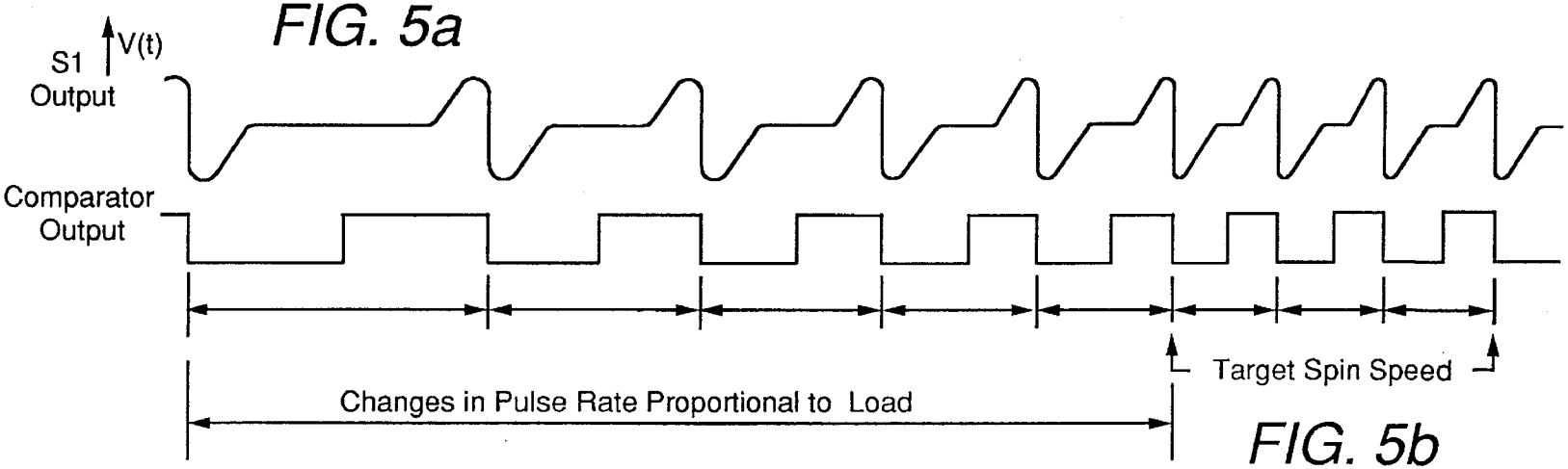
FIG. 5a
FIG. 5b
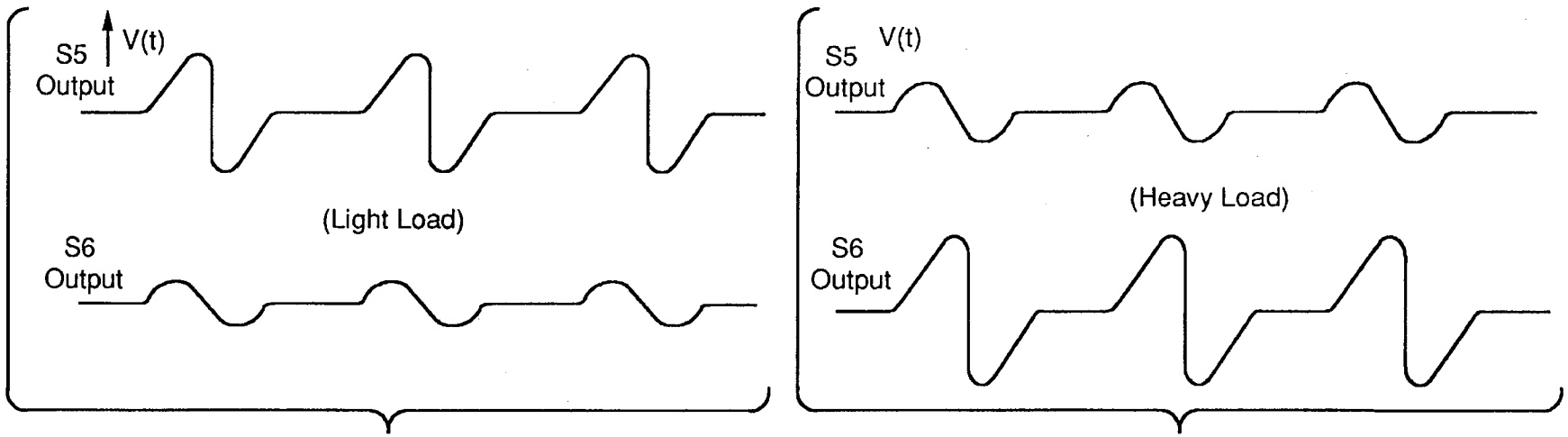
FIG. 7b
FIG. 7a

SYSTEM BASED ON INDUCTIVE COUPLING FOR SENSING LOADS IN A WASHING MACHINE BY MEASURING ANGULAR ACCELERATION

RELATED APPLICATIONS

This application is related to patent application Ser. No. 08/491,775 (RD-23,780), entitled "System Based On Inductive Coupling For Sensing Spin Speed And An Out-Of-Balance Condition", and Ser. No. 08/491,776 (RD-24,441) entitled "System Based On Inductive Coupling For Sensing Loads In a Washing Machine", each filed concurrently with the present invention, assigned to the same assignee of the present invention and herein incorporated by reference.

BACKGROUND OF THE INVENTION

The present invention is generally related to washing machines and, more particularly, to a system based on inductive coupling for sensing load of articles to be cleansed in the washing machine by measuring angular acceleration.

It is useful to accurately sense or measure any load of articles to be cleansed in the washing machine. For example, this load measurement can be used for determining transmission and/or motor performance under various load conditions. Further, the load measurement can be used in a suitable algorithm for optimizing water usage as a function of the actual load condition in the washing machine. It is thus desirable to provide a system for accurately sensing loads in the washing machine. It is also desirable for this sensing system to be flow cost and reliable, i.e., a robust sensing system which does not require elaborate logic to sense loads in the washing machine, and which does not need frequent calibration or resetting.

SUMMARY OF THE INVENTION

Generally speaking, the present invention fulfills the foregoing needs by providing a system for sensing loads in a washing machine which typically includes a washer basket and an agitator that can be angularly accelerated about a predetermined spin axis upon initiating a predetermined dry spin cycle. An exemplary embodiment for the system comprises a magnetic source, such as a permanent magnet, positioned in the agitator for producing a predetermined magnetic field. A magnetic sensor, made-up of inductive coils or solid state sensors, is positioned to be electromagnetically coupled to the magnetic source for supplying an output signal that varies in a predetermined manner as the agitator is angularly accelerated relative to the magnetic sensor. A signal processor is coupled to the magnetic sensor for receiving the output signal supplied by the magnetic sensor. The processor is designed and/or programmed for measuring loads in the washer basket based on the output signal received from the magnetic sensor while the agitator is angularly accelerated relative to the magnetic sensor upon initiating the dry spin cycle.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like parts throughout the drawings, and in which:

FIG. 5*a* shows an exemplary waveform for the output signal supplied by the set of sensing coils of FIG. 4*a* upon initiating a dry spin cycle while FIG. 5*b* shows an exemplary waveform of the output signal from the comparator of FIG. 4*b* upon initiating the dry spin cycle of FIG. 5*a;*

FIG. 7*a* shows exemplary waveforms for the output signals supplied by the sensors of FIG. 6*a* during a light load condition while FIG. 7*b* shows exemplary waveforms during a heavy load condition relative to the load condition of FIG. 7*a.*

DETAILED DESCRIPTION OF THE INVENTION

Figure 1:
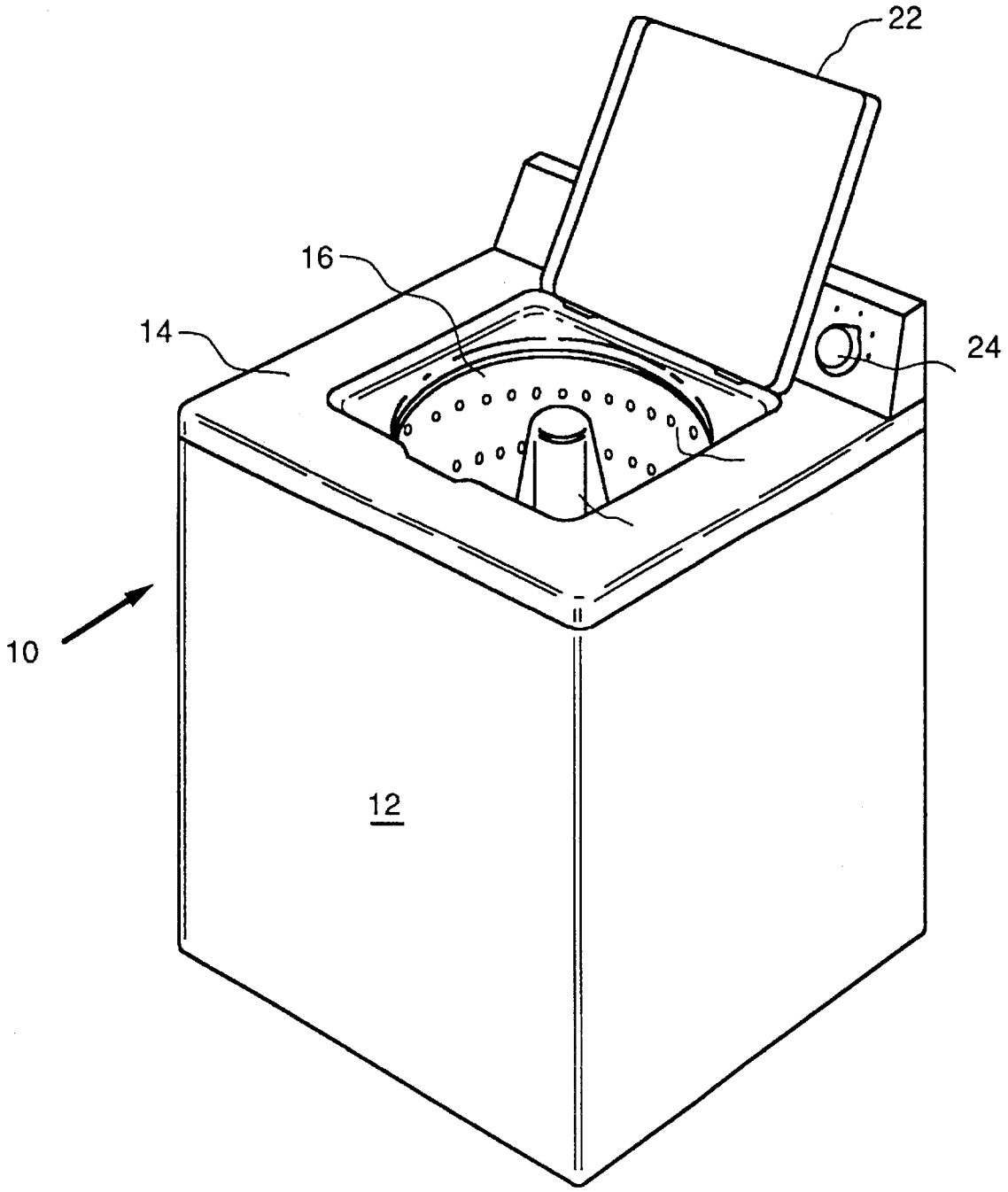
FIG. 1 is a perspective view of a typical top-loading washing machine.

FIG. 1 illustrates a top loading washing machine 10 which has a cabinet 12 having a respective top panel 14 with an access opening 16 for loading and unloading articles to be cleansed in a washer basket 18. In a conventional washing operation, the articles to be cleansed are loaded through access opening 16 into basket 18, and after lid 22 is closed and a control knob 24 or other suitable control device is properly set, the washing machine sequences through a predetermined sequence of cycles such as wash, rinse and spin cycles. An agitator 26 is generally positioned in basket 18 to agitate the articles to be cleansed during the wash and rinse cycles, for example.

Figure 2:
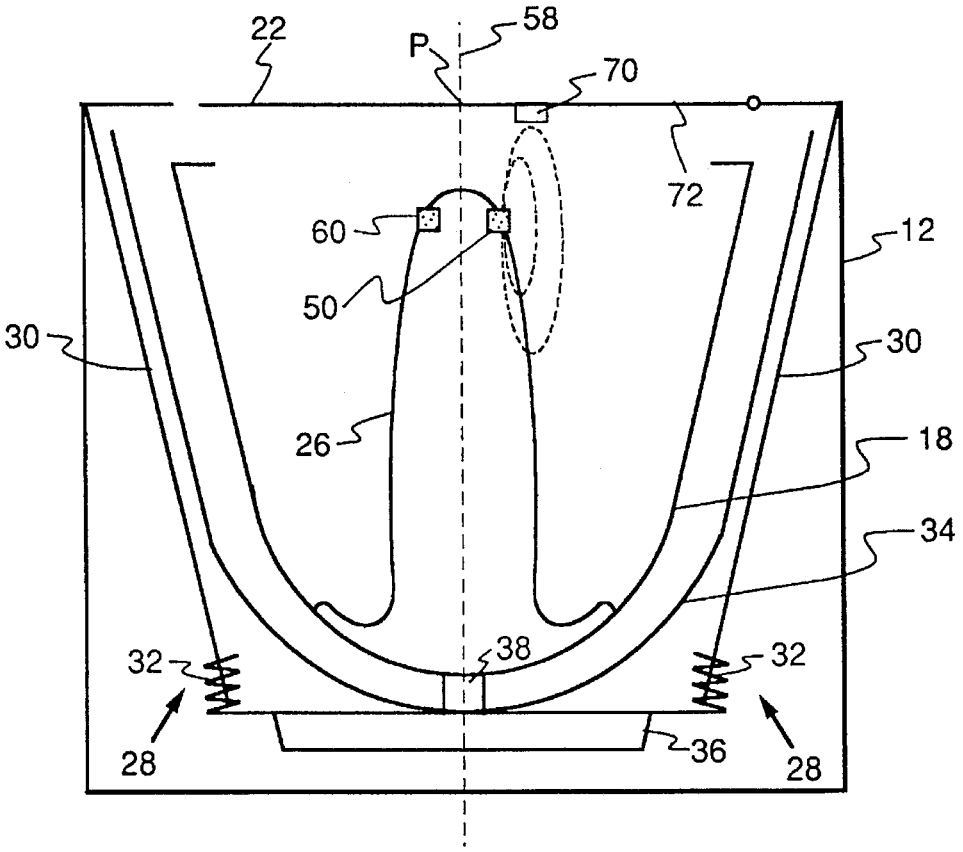
FIG. 2 is a side view schematic of a washing machine incorporating a sensing system in accordance with one preferred embodiment, as claimed in the present invention.

FIG. 2 shows a simplified schematic representation illustrating an exemplary suspension 28 used in washing machine 10 to provide mechanical isolation and support with respect to cabinet 12 of components such as washer basket 18, agitator 26, a tub 34, a motor 36 and a transmission 38. Suspension 28 typically comprises connecting rods 30 and springs 32 suitably selected in accordance with the particular mechanical characteristics of a given washing machine. During the wash and rinse cycles, tub 34 is filled with water and agitator 26 may be driven back and forth by motor 36 respectively linked to agitator 26 and basket 18 by transmission 38, for example.

In accordance with one preferred embodiment, as claimed in the present invention, FIG. 2 further shows a magnetic source 50, such as a permanent magnet, that can be positioned substantially near the tip of agitator 26 for producing a predetermined magnetic field. As shown in FIG. 2, magnetic source 50 is positioned off-axis relative to the spin axis 58 of the washer basket. During a balanced condition, spin axis 58 generally intersects lid 22 at a point P located on an inner surface 72 of lid 22. A suitable counterweight 60 (or another magnet) can be positioned opposite magnetic source 50 for maintaining balance of agitator 26 during spin cycles. FIG. 2 further shows a magnetic sensor 70 attached to inner surface 72 of lid 22 and positioned substantially near the tip of agitator 26 so as to be magnetically coupled to magnetic source 50 for producing an output signal that varies in a predetermined manner as the agitator is angularly accelerated relative to sensor 70, i.e., as the magnet passes near the magnetic sensor. In this embodiment, for the purpose of sensing or measuring article-related load, measurements are taken while the washer basket and agitator are angularly accelerated upon initiating a predetermined dry spin cycle, i.e., a spin performed for a suitable time interval without any water having been introduced into the washer basket. It will be appreciated, however, that the present invention need not be limited to dry-article measurements being that, if desired, the load measurements could readily include the weight of any water in the washer basket and/or the weight of the articles to be cleansed.

Figure 3:
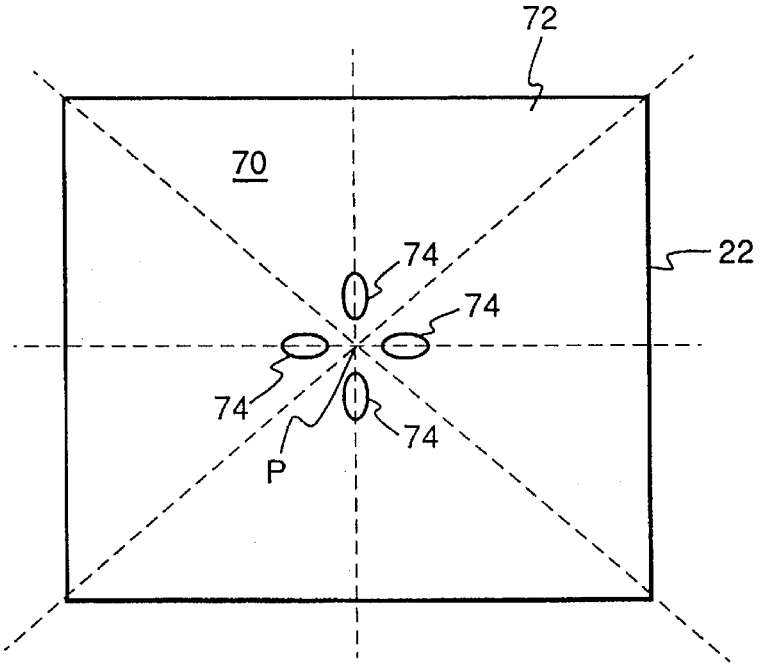
FIG. 3 is a bottom view schematic of the lid of the washing machine showing an exemplary arrangement for magnetic sensors attached to the lid.

FIG. 3 shows an exemplary embodiment for magnetic sensor 70. In this embodiment, magnetic sensor 70 is made up of a single set of four mutually spaced inductive coils 74 affixed to inner surface 72 of lid 22. By way of example and not of limitation, each coil 74 in this set of coils is positioned substantially equidistant at a predetermined distance from point P on the inner surface of the lid. As shown in FIG. 3, each coil 74 is positioned at a predetermined angle with respect to one another on the plane defined by inner surface 72. This predetermined angle can be conveniently chosen to position respective ones of coils 74 in substantially equiangular relationship relative to one another. It will be appreciated by those skilled in the art that the actual number of coils is not critical being that even a single coil could be used for sensing loads in the washing machine. The actual number of coils is readily chosen based on the desired resolution and accuracy for the sensing system being that system resolution and accuracy are proportional to the number of sensing coils employed. Although the above description for magnetic sensor 70 was made in terms of inductive coils, it will be appreciated by those skilled in the art that the magnetic sensor need not be limited to inductive coils being that solid state magnetic sensors, such as Hall-effect sensors, magnetoresistive sensors and the like, could be conveniently employed in lieu of inductive coils.

Figure 4A:
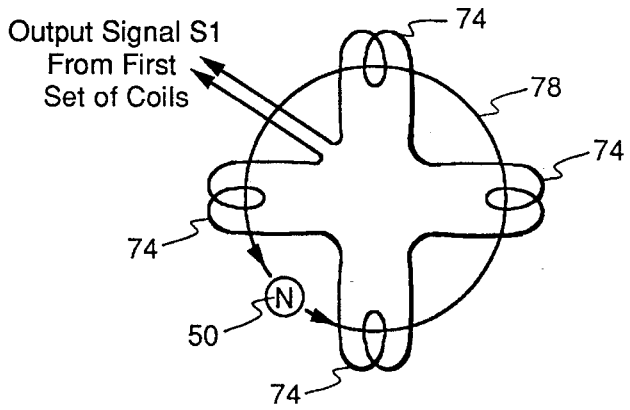
FIG. 4*a* shows a schematic diagram for one set of sensing coils connected to supply an output signal capable of being processed for measuring loads in the washing machine.
Figure 4B:
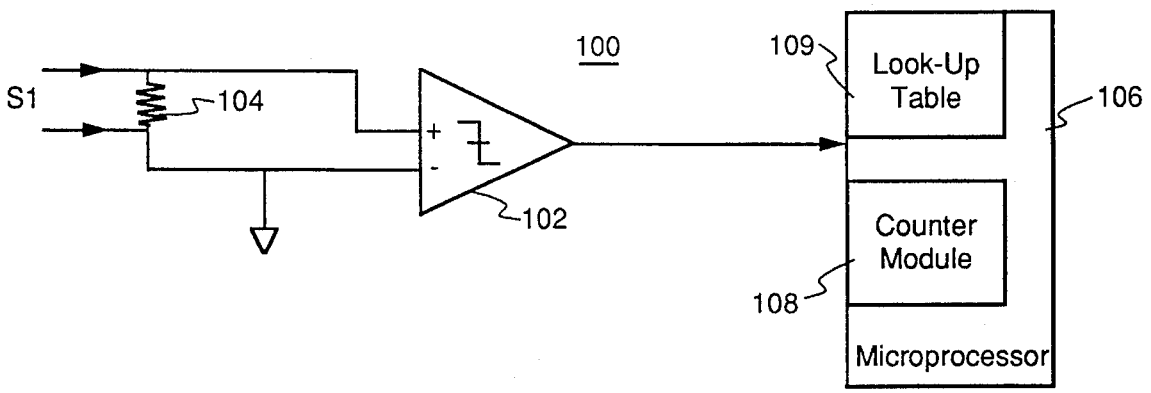
FIG. 4*b* shows a schematic diagram of an exemplary signal processor including a comparator for receiving the output signal from the set of sensing coils of FIG. 4*a;*

FIG. 4*a* shows an exemplary connection for the set of coils 74. As shown in FIG. 4*a* each coil 74 is serially coupled to one another so that the set of coils supplies a combined output signal S1 capable of being processed for measuring loads in the washing machine, i.e., measuring the weight of the articles contained in the washer basket of the washing machine. FIG. 4*a* further shows an exemplary path 78 for magnet 50 relative to coils 74 as the agitator is angularly accelerated upon initiating the dry spin cycle, for example. FIG. 4*b* illustrates a signal processor 100 that processes the output signal S1 from coils 74 to determine the load in the washer basket. As shown in FIG. 4*b*, signal processor 100 includes a comparator 102 having two input ports, coupled through a suitable resistor 104, for receiving the output signal from the set of coils 74. Comparator 102 supplies a comparator output signal that provides a stream of pulses based on the polarity of the received output coil signal. The comparator output signal is supplied to a microprocessor 106 having a counter module 108 which allows for measuring load based on changes in the number of pulses received per unit of time, i.e., based on changes in the pulse rate. This follows since, for a substantially load-independent torque provided by motor 36 (FIG. 2) to the washer basket, changes in the pulse rate are proportional to the moment of inertia of the washer basket, which in turn is proportional to the load in the washer basket. Thus, by measuring changes in the pulse rate while the agitator and washer basket are angularly accelerated, such as upon initiating the dry spin cycle until a predetermined target spin speed is reached, processor 100 can readily determine the load in the washer basket. For example, the measured changes in pulse rate, i.e., the measured angular acceleration, can be readily compared against values stored in a look-up table 109 for relating or referencing values of angular acceleration to values for the load size. It will be appreciated that a simple calibration procedure, such as measuring angular acceleration with no load in the washer basket, could be performed at suitable time intervals for dynamically updating the values stored in the look-up table to compensate for any changes in the operational characteristics of the system. As described in U.S. patent application Ser. No. 08/491,775 (RD-23,780), entitled "System Based On Inductive Coupling For Sensing Spin Speed And An Out-Of-Balance Condition", filed on Jun. 19, 1995, for a substantially constant spin speed, the pulse rate is substantially constant and thus changes in the pulse rate are essentially zero for a constant spin speed. In contrast, for a changing spin speed, i.e., during periods of angular acceleration, changes in the pulse rate have a nonzero value, which is proportional to the load in the washer basket as explained above.

FIG. 5*a* shows an exemplary waveform for the output signal S1 supplied by the set of coils 74 upon initialization of the dry spin cycle, while FIG. 5*b* shows an exemplary waveform for the comparator output signal upon initialization of the dry spin cycle. As suggested above, the load in the washer basket can be accurately measured by simply measuring angular acceleration, i.e., measuring changes in the number of pulses received per unit of time. It will be appreciated that one important advantage of the present invention is its simplicity of implementation. This allows for providing, at a low cost, a reliable and versatile sensing system.

Figure 6A:
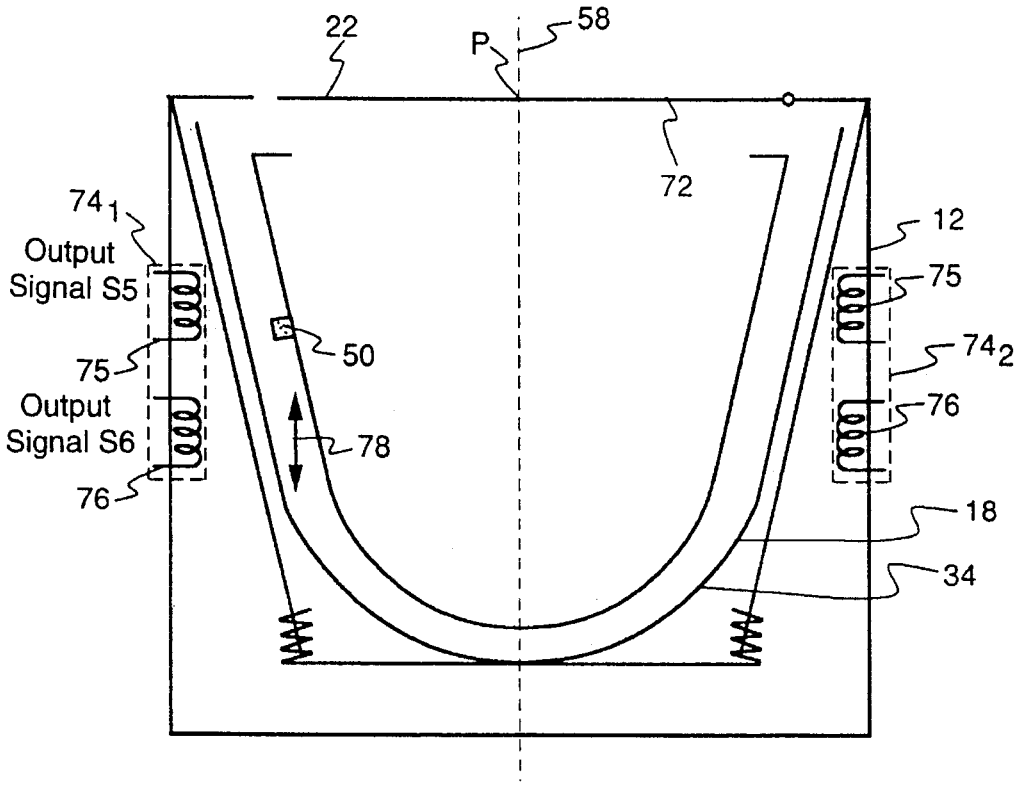
FIG. 6*a* is a side view schematic of a washing machine incorporating a sensing system using one or more sensors made up of two magnetic sensing elements in accordance with another preferred embodiment, as claimed in concurrently-filed U.S. application Ser. No. 08/491,776 (RD-24,441)

In accordance with another preferred embodiment, as claimed in concurrently-filed U.S. application Ser. No. 08/491,776 (RD-24,441), FIG. 6*a* shows that magnetic source 50 can be laterally attached to washer basket 18, i.e., attached to a lateral section of washer basket 18. In this case, at least one sensor $\mathbf{74}_1$ is attached, at a predetermined height, to a predetermined lateral wall of cabinet 12 to be electromagnetically coupled to magnetic source 50 as washer basket 18 rotates relative to sensor $\mathbf{74}_1$. By way of example, sensor $\mathbf{74}_1$ is made up of a first magnetic sensing element, such as an inductive coil 75, and a second sensing element, such as an inductive coil 76. It will be appreciated by those skilled in the art that suspension system 28 (FIG. 2) that supports the washer basket can be readily designed for allowing the washer basket, and in turn the magnetic sensor, to travel along a predetermined travel axis 78 based on the load in the washer basket. For example, the travel axis can extend in a generally vertical direction, i.e., a direction generally parallel relative to the lateral walls of the cabinet. Thus, as the washer basket is loaded, the washer basket, including the magnetic source, will sink or droop relative to sensor $74_1$. Thus, the respective relative positioning of each coil 75 and 76 with respect to the magnetic source can be conveniently employed for obtaining load information as the washer basket rotates about the spin axis. For example, each coil 75 and 76 can be situated to have a predetermined spacing between one another along the predetermined travel axis. In this manner, the relative positioning of the first and second coils 75 and 76 with respect to any actual path traveled by the magnet during the dry spin cycle (or even during a dry agitation cycle characterized by back-and-forth motion of the agitator) allows for generating respective output signals that can be readily processed for measuring the load in the washer basket. This embodiment assumes that both the washer basket and the tub are made of a suitable nonmagnetic material, such as plastic and the like. It will be appreciated by those skilled in the art that additional sensors, such as sensor $74_2$, substantially identical to sensor $74_1$, can be attached to predetermined additional lateral walls of the cabinet at substantially the same predetermined height relative to one another. By way of example, each sensor can be situated to have a predetermined angle with respect to one another in a substantially horizontal plane, i.e., in a plane substantially perpendicular to the travel axis for the washer basket. For a case of two sensors, such angle could be conveniently chosen as 90° or 180°. In a more general case, the predetermined angle can be conveniently chosen to position respective ones of the additional sensors and the one sensor in substantial equiangular relationship relative to one another in the substantially horizontal plane. Thus, in general, an angle $\phi$ could be chosen so that $\phi=360°/N$, wherein N represents the total number of sensors used in the sensing system. The actual number of sensors is readily chosen based on the desired resolution and accuracy for the sensing system being that system resolution and accuracy are proportional to the number of sensors employed. As described in the context of FIG. 4*a*, each respective one of the first sensing elements in each sensor $74_1$ and $74_2$ can be serially connected to one another to supply a respective combined output signal having a respective amplitude that varies based on the relative positioning of each first sensing element with respect to the magnetic source, as the magnetic source passes near sensors $74_1$ and $74_2$. Similarly, each respective one of the second sensing elements in each sensor $74_1$ and $74_2$ is respectively connected to one another to supply a respective combined output signal that varies based on the relative positioning of each second sensing element with respect to the magnetic source, as the magnetic source passes near sensors $74_1$ and $74_2$. Again it will be appreciated by those skilled in the art that the sensors need not be limited to inductive coils being that other magnetic sensing elements, such as solid state magnetic sensors, could be conveniently employed in lieu of inductive coils.

Figure 6B:
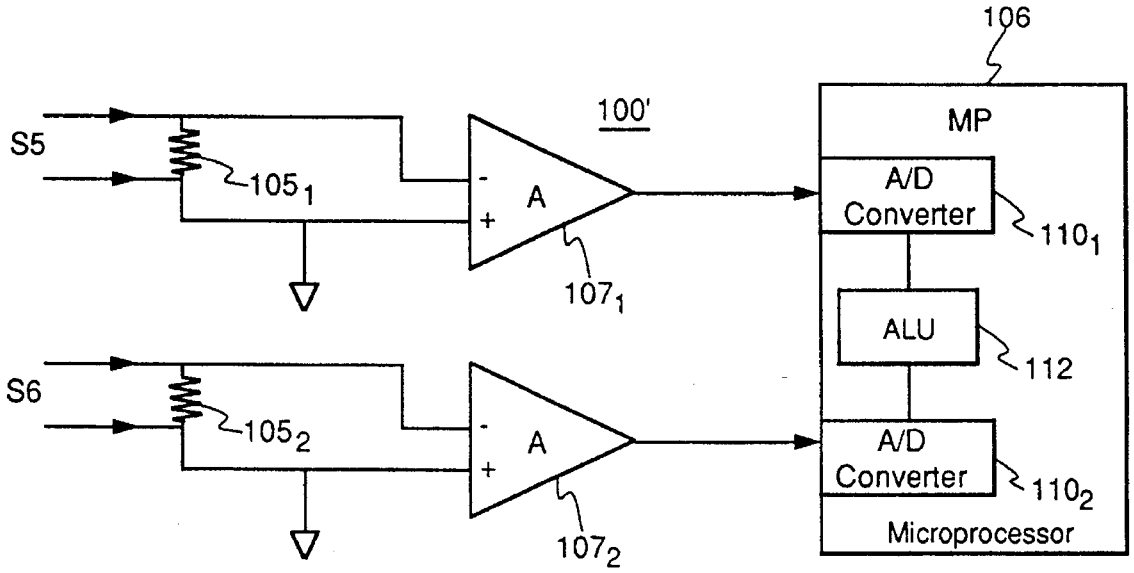
FIG. 6*b* shows a schematic diagram of an exemplary signal processor for processing the output signals supplied from the sensors of FIG. 6*a*.

FIG. 6*b* shows a signal processor 100' that allows for measuring load by performing relatively simple signal processing on output signals S5 and S6 respectively supplied from the first and second sensing elements 75 and 76. As shown in FIG. 6*b*, signal processor 100' includes a first amplifier, such as an operational amplifier $107_1$ having two input ports, coupled through a suitable resistor $105_1$, for receiving output signal S5 from each first sensing element 75. Signal processor 100' further includes a second amplifier, such as an operational amplifier $107_2$ having two input ports, coupled through a suitable resistor $105_2$, for receiving output signal S6 from each second sensing element 76. For example, after respective suitable amplification of signals S5 and S6 in operational amplifiers $107_1$ and $107_2$, each amplifier output signal is supplied to microprocessor 106 to be digitized using respective analog-to-digital converters $110_1$ and $110_2$. An arithmetic logic unit (ALU) 112 in microprocessor 106 allows for taking the ratio of the respective digitized signals so as to determine the load in the washer basket. For example, if the ratio of the amplitude of the digitized output signal from each first sensing element 75 over the amplitude of the digitized output signal from each second sensing element 76 is computed in ALU 112, then during a relatively light load condition such ratio may be larger than unity, while during a relatively heavy load condition such ratio may be below unity.

Respective exemplary waveforms for the S5 and S6 output signals during a light load condition are shown in FIG. 7*a*. In this case the peak-to-peak values for the output signal S5 will be larger than the peak-to-peak values for the output signal S6 being that each coil 75 would be closer to the magnet path than each coil 76. Respective exemplary waveforms for the S5 and S6 output signals during a heavy load condition are shown in FIG. 7*b*. In this case the peak-to-peak values for the output signal S6 will be larger than the peak-to-peak values for the output signal S5 being that each coil 76 would, for a relatively heavier load, be closer to the magnet path than each coil 75.

While only certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A washing machine comprising:

a cabinet having a lid;

a tub being inside said cabinet;

a washer basket for holding articles to be cleansed, said basket being positioned in said tub;

an agitator positioned in said washer basket;

means for accelerating said washer basket and said agitator about a predetermined spin axis upon initiating a predetermined dry spin cycle;

a system comprising:

a magnetic source positioned in said agitator for producing a predetermined magnetic field;

a magnetic sensor positioned to be electromagnetically coupled to said magnetic source for supplying an output signal that predeterminedly varies as said agitator is angularly accelerated relative to said magnetic sensor; and a signal processor coupled to said magnetic sensor for receiving the output signal supplied by said magnetic sensor, said signal processor being adapted for measuring load in said washer basket based on the output signal received from said magnetic sensor while said agitator is angularly accelerated relative to said magnetic sensor.

2. The washing machine of claim 1 wherein said magnetic source is positioned substantially at the tip of said agitator.

3. The washing machine of claim 2 wherein said magnetic sensor comprises a set of mutually spaced coils affixed to an inner surface of the lid of said washing machine.

4. The washing machine of claim 3 wherein each coil in said set of coils is positioned substantially equidistant from a point in said inner surface intersected by said spin axis.

5. The washing machine of claim 4 wherein each coil in said set of coils is positioned at a predetermined angle with respect to one another.

6. The washing machine of claim 5 wherein said predetermined angle is chosen to position respective ones of said mutually spaced coils in substantially equiangular relationship relative to one another.

7. The washing machine of claim 3 wherein said signal processor comprises a comparator coupled to receive the output signal from said set of coils and a microprocessor coupled to said comparator for processing the comparator output signal so as to determine the load in said washer basket.

8. The washing machine of claim 7 wherein said microprocessor includes a counter for measuring pulse rate changes in the, comparator output signal and a look-up table for referencing the measured pulse rate changes against predetermined values stored in said look-up table for determining the load in said washer basket.

9. The washing machine of claim 1 wherein said magnetic sensor comprises a solid state magnetic sensor selected from the group consisting of magnetoresistive and Hall-effect solid state magnetic sensors.

10. A system for sensing loads in a washing machine having a tub inside a cabinet with a lid, said tub enclosing a washer basket for holding articles to be cleansed and an agitator, said washing machine including means for angularly accelerating said basket and said agitator about a predetermined spin axis during a predetermined dry spin cycle, said system comprising:

a magnetic source positioned in said agitator for producing a predetermined magnetic field;

a magnetic sensor positioned to be electromagnetically coupled to said magnetic source for supplying an output signal that predeterminedly varies as said agitator is angularly accelerated relative to said magnetic sensor; and a signal processor coupled to said magnetic sensor for receiving the output signal supplied by said magnetic sensor, said signal processor being adapted for measuring load in said washer basket based on the output signal received from said magnetic sensor while said agitator is angularly accelerated relative to said magnetic sensor.

11. The system of claim 10 wherein said magnetic source is positioned substantially at the tip of said agitator.

12. The system of claim 11 wherein said magnetic sensor comprises a set of mutually spaced coils affixed to an inner surface of the lid of said washing machine.

13. The system of claim 12 wherein each coil in said set of coils is positioned substantially equidistant from a point in said inner surface intersected by said spin axis.

14. The system of claim 13 wherein each coil in said set of coils is positioned at a predetermined angle with respect to one another.

15. The system of claim 14 wherein said predetermined angle is chosen to position respective ones of said mutually spaced coils in substantially equiangular relationship relative to one another.

16. The system of claim 12 wherein said signal processor comprises a comparator coupled to receive the output signal from said set of coils and a microprocessor coupled to said comparator for processing the comparator output signal so as to determine the load in said washer basket.

17. The system of claim 16 wherein said microprocessor includes counter means for measuring pulse rate changes in the comparator output signal and a look-up table for referencing the measured pulse rate changes against predetermined values stored in said look-up table for determining the load in said washer basket.

18. The system of claim 10 wherein said magnetic sensor comprises a solid state magnetic sensor selected from the group consisting of magnetoresistive and Hall-effect solid state magnetic sensors.

* * * * *